US010252857B1

(12) United States Patent
Reed

(10) Patent No.: US 10,252,857 B1
(45) Date of Patent: Apr. 9, 2019

(54) TRASH CONTAINER

(71) Applicant: Erik P. Reed, Mansfield, TX (US)

(72) Inventor: Erik P. Reed, Mansfield, TX (US)

( * ) Notice: Subject to any disclaimer, the term of this patent is extended or adjusted under 35 U.S.C. 154(b) by 0 days.

(21) Appl. No.: 15/285,654

(22) Filed: Oct. 5, 2016

Related U.S. Application Data

(60) Provisional application No. 62/237,383, filed on Oct. 5, 2015.

(51) Int. Cl.
*B65F 1/06* (2006.01)
*B65F 1/14* (2006.01)

(52) U.S. Cl.
CPC ..... *B65F 1/06* (2013.01); *B65F 1/1452* (2013.01)

(58) Field of Classification Search
CPC ..... B65F 1/00; B65F 1/04; B65F 1/06; B65F 1/068; B65F 1/12; B65F 1/16; B65F 1/1615; B65F 1/1452; B65F 1/1442; B65F 2001/1653; B65F 2001/1669
USPC ..... 220/495.06, 495.08, 495.11, 908, 908.1, 220/833, 834, 4.01, 4.22
See application file for complete search history.

(56) References Cited

U.S. PATENT DOCUMENTS 5,720,382 A * 2/1998 Porter ..... A01F 25/13 150/154
9,010,069 B2 * 4/2015 Bernard ..... E04H 12/2292 52/844
9,481,514 B2 * 11/2016 O'Brien ..... B65F 1/06
2008/0087676 A1 * 4/2008 Kasboske ..... B65D 21/086 220/666
2009/0026208 A1 * 1/2009 McKenzie ..... B65F 1/068 220/495.06

* cited by examiner

*Primary Examiner* — Steven A. Reynolds
*Assistant Examiner* — Javier A Pagan
(74) *Attorney, Agent, or Firm* — Eldredge Law Firm, LLC; Richard Eldredge; Beth Felix

(57) ABSTRACT

A trash container includes a base; a first elongated section pivotally attached to the base; a second elongated section pivotally attached to the base and pivotally attached to the first elongated section; and a hinge secured to and extending from the base and fixedly attached to both the first elongated section and the second elongated section.

1 Claim, 3 Drawing Sheets

TRASH CONTAINER

BACKGROUND

1. Field of the Invention

The present invention relates generally to trash containers which are used to temporarily hold waste, and more specifically, to a trash container which can be pivoted open to allow the user to remove the trash bag from the front of the container.

2. Description of Related Art

Trash containers are known in the art and provide a viable means of temporarily storing garbage. In FIG. 1, a commonly known trash container system 101 is shown. System 101 includes a lower container body 107 which forms an open volume. A trash bag is commonly inserted in the lower container body 107 prior to installing the upper lid 103. The lid 103 is shaped such that it forms a closed enclosure when installed on the lower container body 107. It is appreciated that prior art of systems similar to system 101 exist which do not contain an upper lid 103. The upper lid 103 contains a door 105 which pivotably opens relative to the upper lid 103. The door 105 provides a means for the user to quickly place trash into the trash container system 101 while still providing protection from environmental conditions such as rain and snow.

As shown in FIG. 1, conventional trash container systems similar to that shown in system 101 commonly require the operator to remove the trash bag by lifting it vertically out of the lower container body 107. This oftentimes results in trash bag tears and/or trash spills due to the trash container being overfilled. This is viewed as a disadvantage of conventional trash container systems.

Although great strides have been made in the area of trash container systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
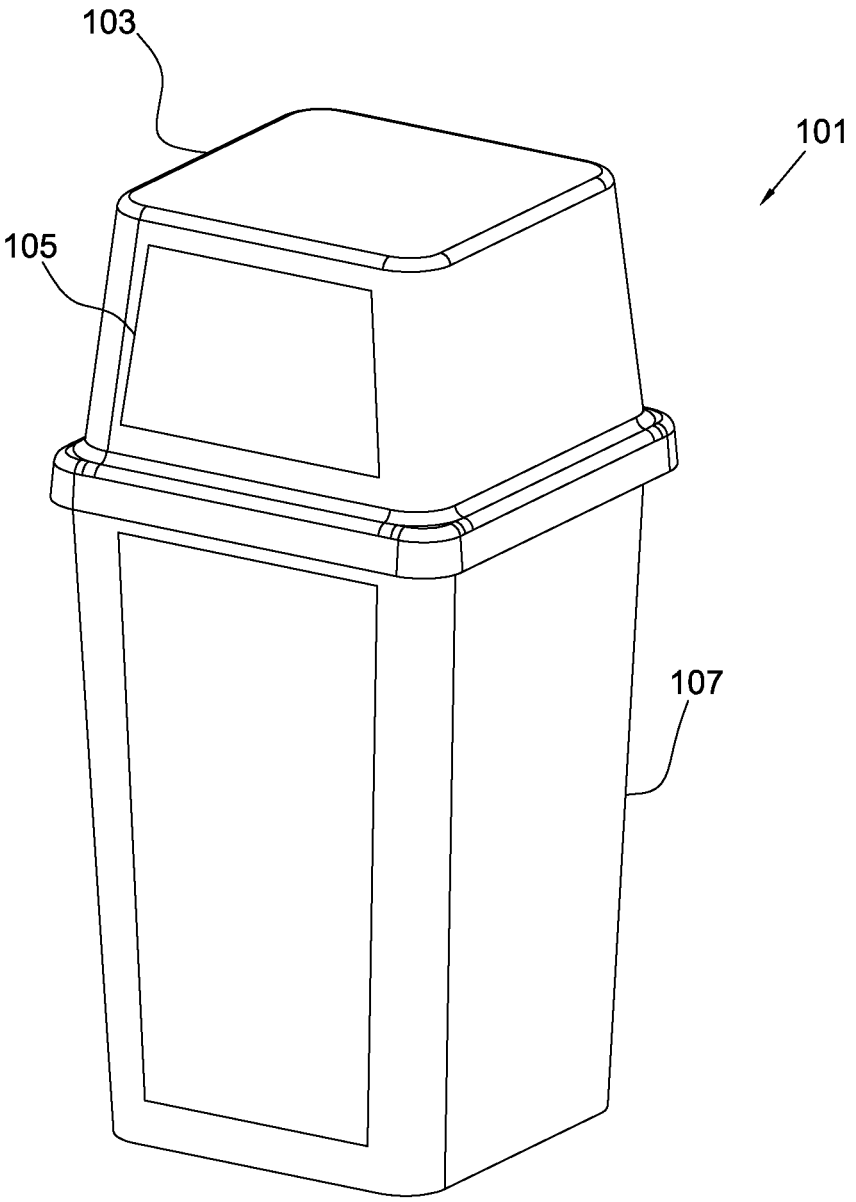
FIG. 1 (PRIOR ART)
FIG. 1 is an oblique view of a conventional trash container system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional trash container systems. Specifically, the system of the present application provides the user with a trash container which includes two halves that can be pivotably opened to provide a means of removing the full bag of trash from the front side of the container. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
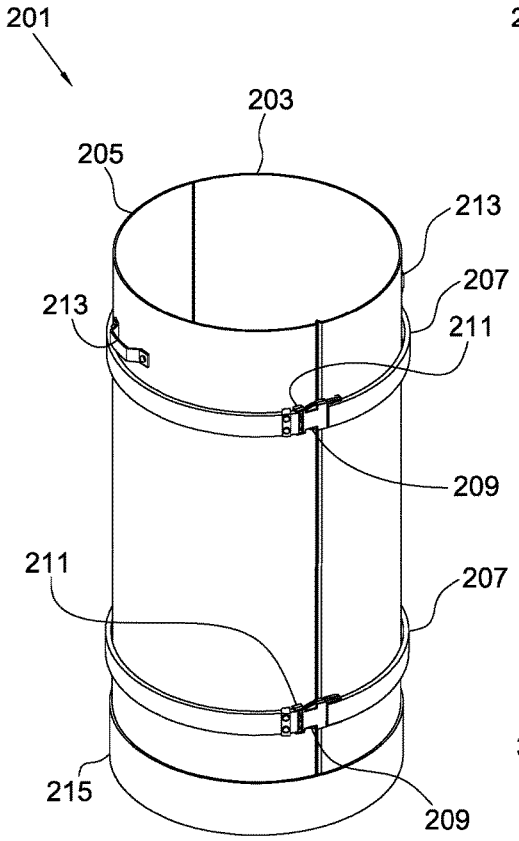
FIG. 2 is an oblique view of a trash container system in accordance with a preferred embodiment of the present application.
Figure 3:
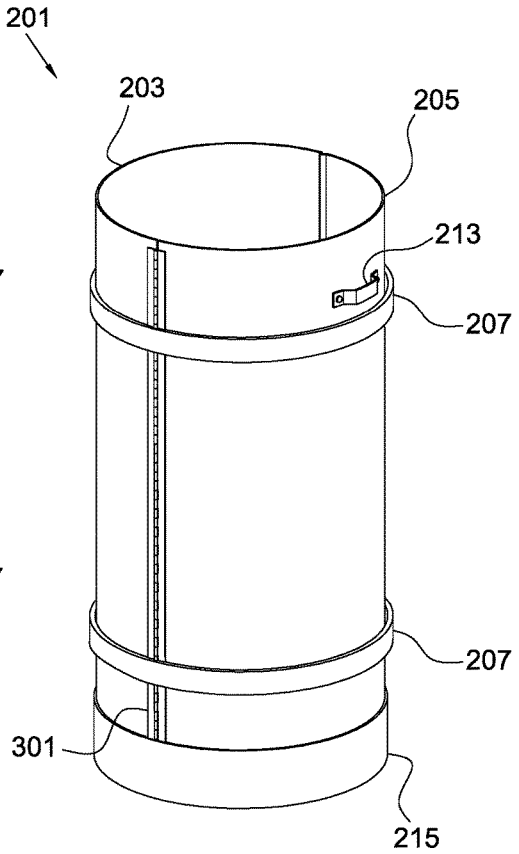
FIG. 3 is an oblique view of the trash container system given in FIG. 2.

Referring now to the drawings wherein like reference characters identify corresponding or similar elements throughout the several views, FIGS. 2 and 3 depict a trash container system 201 in accordance with a preferred embodiment of the present application. It will be appreciated that system 201 overcomes one or more of the above-listed problems commonly associated with the conventional trash container systems.

In a preferred embodiment, system 201 includes trash container sections 203 and 205 which are pivotably attached by a hinge 301. It is appreciated that the lower portion of container sections 203 and 205 are configured to create a closed bottom cylinder. The lower closed bottom cylinder portion of container sections 203 and 205 form a closed volume similar to a drip pan which will hold the bottom of the trash bag and catch any leaking liquids that might be present. It is contemplated that the hinge 301 could be replaced with multiple "lift off" style hinges in alternate embodiments which would provide a means for quickly removing the container sections 203 and 205.

The trash container sections 203 and 205 are preferably depicted as circular in shape in FIGS. 2 and 3; however, it is appreciated that the sections could be configured in many different shapes including, but not limited to, square, rectangular, oval, and polygonal. It is contemplated that the trash container system 201 is modular in size; hence, many configurations exist for each preferred trash container volume size. The trash container sections 203 contain many unique features which will be discussed in further detail below.

One or more handles 213 are included and are fixably attached to the container sections 203 and 205. The handles 213 provide a means for the user to ergonomically lift and carry the container system 201. It is contemplated that the handles could be attached in many different places on system 201. The exemplary, preferred embodiment also includes one or more straps 207 with buckles 209 and 211 as depicted in FIGS. 2 and 3. The straps 207 are removably attached to the container sections 203 and 205 and provide a means for the user to strongly hold the said sections in the closed position. It is appreciated that the straps 207 can be retained to the container sections 203 and/or 205 by single or multiple point attachment while the buckles 209 and 211 are not connected.

Figure 4:
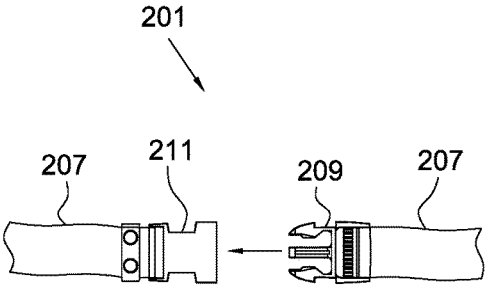
FIG. 4 is a front view of the buckle of the trash container system given in FIG. 2.

Referring now to FIG. 4, a front view of the buckles of system 201 is shown. The buckles 209 and 211 are attached to the ends of the strap 207. The buckles 209 and 211 contain geometry which mechanically lock together creating a retained loop strap. It is contemplated that since many strap materials and configurations exist, the buckles 209 and 211 are shown for illustrative purposes only. It is contemplated that the strap system could be composed of many readily available strap materials such as hook and loop fastener straps, ratcheting systems, elastic cords with hooks, metal loops, and/or a combination of each.

Figure 5:
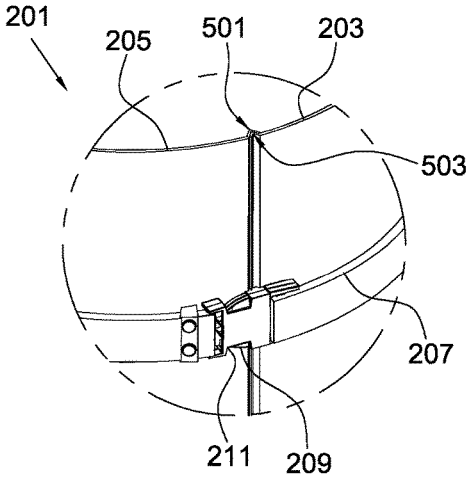
FIG. 5 is a partial oblique view of the trash container system given in FIG. 2.

Referring now to FIG. 5, a partial oblique view of the system 201 is respectively shown. FIG. 5 depicts uniquely formed "V" shaped joint having surfaces 501 and 503 formed on respective ends of section 203, 205. As depicted, the locking joint extends the entire length of the sections. The "V" shaped surfaces 501 and 503 are configured such that they fit inside each other when the container sections 203 and 205 are closed. This unique feature provides the user with a controlled closed position and it reliably holds the system in the closed position while the straps 207 are not being used. This is viewed as an advantage of the system of the present application.

It is contemplated that many complementary geometries exist which could be used in place of the "V" shape in FIG. 5; therefore, the "V" shape is shown for illustrative purposes only in order to capture the spirit of the present application. Other contemplated geometries include, but are not limited to, semi-circles, squares, polygons, cam shapes, etc. It is appreciated that the depicted formed profile exists as a means of mechanically holding the container sections 203 and 205 closed and can excluded.

Figure 6:
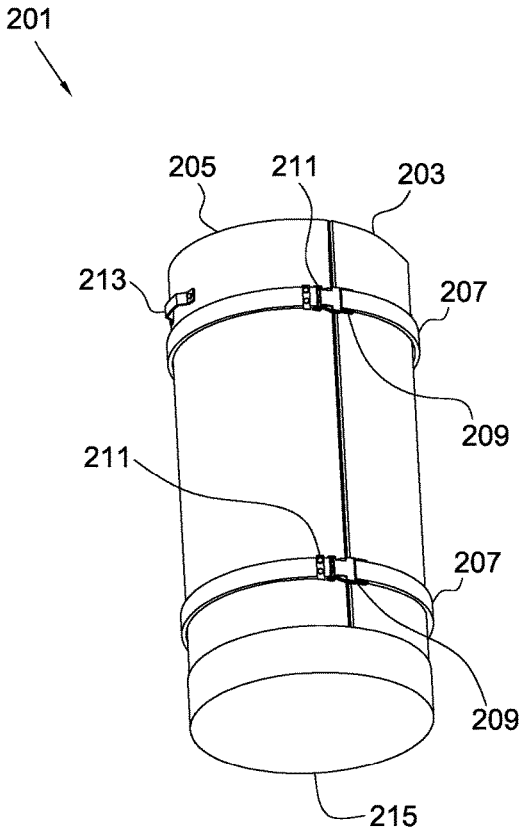
FIG. 6 is an oblique view of the trash container system given in FIG. 2.

Referring now to FIG. 6, an oblique view of the system 201 is shown. The bottom of system 201 is depicted which shows the lower base 215. The base 215 configured to snugly fit on the container sections 203 and 205 which strengthens the lower portion of the container system 201. It is contemplated that the lower base 215 could be mechanically attached to system 201 in alternate embodiments through the use of conventional attachments methods such as cam latches, buckles with straps, mechanical fasteners, and/or locking mechanisms. It is contemplated that transport wheels could be added under the base 215 in a alternate embodiments to provide a means for portability.

Figure 7A:
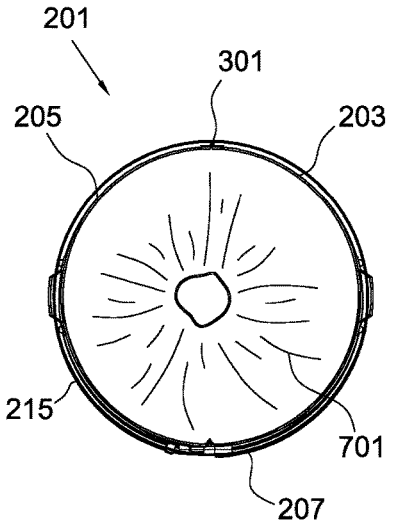
FIGS. 7A & 7B are top views of the trash container system given in FIG. 2.
Figure 7B:
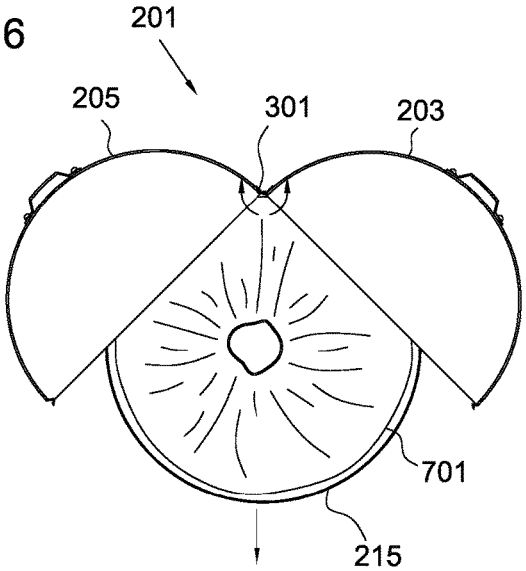

Finally referring to FIGS. 7A and 7B, top views of system 201 are given which depict the method of removing a full bag of trash from the trash container system. Firstly, the straps 207 are loosened and/or removed. Secondly, the container sections 203 and 205 are pivoted open in opposing directions about hinge 301. The full bag of trash 701 is removed from the front of the container; therefore, highly reducing the possibility of tearing the bag or spilling the trash. This is viewed as an advantage of the system of the present application. It is contemplated that an upper lid which contains a pivotable door could be included in an alternate embodiment to provide a means of enclosing the trash storage area.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A trash container, comprising:

a base;

a first elongated section pivotally attached to the base, the first elongated section having a first v-shaped joint extending the length of the first elongated section;

a second elongated section pivotally attached to the first elongated section, the second elongated section having a second v-shaped joint extending the length of the second elongated section, the second v-shaped joint fits within the first v-shaped joint, such that a first pointed edge of the first v-shaped joint and a second pointed edge pf the second v-shaped joint align, thereby forming a single v-shaped lock;

a hinge secured to and extending from the base, the hinge is attached to both the first elongated section and the second elongated section;

a first strap fixedly secured to the first elongated section and configured to wrap around a periphery formed by the first elongated section and the second elongated section; and a second strap fixedly secured to the first elongated section at a space apart from the first strap and configured to wrap around the periphery formed by the first elongated section and the second elongated section;

wherein the first elongated section and the second elongated section pivot relative to each other via the hinge and are secured to the base via the hinge; and wherein the first elongated section and the second elongated section form an opening to receive a removable bag therein.

* * * * *